US006511298B2

(12) United States Patent
Takura et al.

(10) Patent No.: US 6,511,298 B2
(45) Date of Patent: Jan. 28, 2003

(54) ELECTRIC MOTOR PUMP WITH AXIAL-FLOW IMPELLERS

(75) Inventors: Toshiyasu Takura, Hino (JP); Yoshifumi Tanabe, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/773,344

(22) Filed: Jan. 31, 2001

(65) Prior Publication Data

US 2001/0012487 A1 Aug. 9, 2001

(30) Foreign Application Priority Data

Feb. 8, 2000 (JP) ..... 2000-030873

(51) Int. Cl.[7] ..... F04B 17/03

(52) U.S. Cl. ..... 417/350; 417/423.5; 417/423.15; 417/365

(58) Field of Search ..... 417/350, 365, 417/423.3, 423.5, 423.12, 423.15, 423.8

(56) References Cited

U.S. PATENT DOCUMENTS 3,022,739 A * 2/1962 Herrick et al. ..... 103/87
3,094,272 A * 6/1963 McClure ..... 230/117
5,478,215 A * 12/1995 Kobayashi et al. .... 417/423.14
5,616,013 A * 4/1997 Kobayashi et al. .... 417/423.14
5,857,841 A * 1/1999 Kobayashi et al. ..... 417/350
5,888,053 A * 3/1999 Kobayashi et al. ..... 417/244
6,193,473 B1 * 2/2001 Mruk et al. ..... 417/350

FOREIGN PATENT DOCUMENTS

| | | |
|---|---|---|
| IT | 0 766 366 A1 * | 4/1997 |
| JP | 58-8295 | 1/1983 |
| JP | 8-177782 | 7/1996 |
| JP | 9-209976 | 8/1997 |

* cited by examiner

*Primary Examiner*—Charles G. Freay
*Assistant Examiner*—Han L. Liu
(74) *Attorney, Agent, or Firm*—Frishauf, Holtz, Goodman & Chick, P.C.

(57) ABSTRACT

An electric motor pump with axial-flow impellers includes an electric motor having an output shaft both end portions of which are connected to axial-flow impeller units, and a pair of pump housings provided on both sides of the motor in the longitudinal direction of the output shaft and including fluid inlet and outlet ports, the pump housings cooperating with the impeller units to suck fluid into the housings through the inlet ports, move the fluid in the longitudinal direction and discharge the fluid from the outlet ports, thrust forces applied to the output shaft by the impeller units are canceled.

4 Claims, 3 Drawing Sheets

ELECTRIC MOTOR PUMP WITH AXIAL-FLOW IMPELLERS

CROSS-REFERENCE TO RELATED APPLICATIONS

This application is based upon and claims the benefit of priority from the prior Japanese Patent Application No. 2000-030873, filed Feb. 8, 2000, the entire contents of which are incorporated herein by reference.

BACKGROUND OF THE INVENTION

The present invention relates to an electric motor pump with axial-flow impellers.

The electric motor pump of this type is known from U.S. Pat. No. 5,888,053, Jpn. Pat. Appln. KOKAI Publication No. 9-209976, Jpn. Pat. Appln. KOKAI Publication No. 8-177782, and Jpn. Pat. Appln. KOKAI Publication No. 58-8295.

An electric motor pump with axial-flow impellers comprises at least two axial-flow impellers, and an electric motor for rotating the axial-flow impellers. The electric motor further comprises an output shaft connected to the axial-flow impellers, radial bearings for rotatably supporting the output shaft, and a mechanism for rotating the output shaft. When the axial-impellers are driven for providing energy to a fluid in the electric motor pump, a thrust load is applied to the output shaft of the electric motor. This thrust load becomes larger with an increase in a discharge amount and/or a discharge pressure of the fluid. In order to receive this thrust load, a thrust bearing is required in addition to the radial bearings in the conventional electric motor. Furthermore, the thrust bearing becomes larger and more expensive with an increase in the discharge amount and/or the discharge pressure of the fluid.

The thrust bearing increases the weight and external size of the conventional electric motor pump described above, and raises its price as well.

The present invention has been contrived under the above circumstances, and an object of the present invention is to provide an electric motor pump with axial-flow impellers, which can omit the thrust bearing, can reduce the weight and external size as compared with the conventional electric motor pumps having axial-flow impellers, can decrease the noise generated therefrom, and does not shorten a life thereof.

BRIEF SUMMARY OF THE INVENTION

In order to achieve the object of this invention described above, the electric motor pump with the axial-flow impellers, according to the present invention, comprises:

a pair of axial-flow impeller units;

an electric motor including an output shaft having both end portions connected to the pair of axial-flow impeller units, radial bearings for rotatably supporting the output shaft, and a mechanism for rotating the output shaft; and a pair of pump housings provided on both sides of the electric motor in the longitudinal direction of the output shaft and including fluid inlet and outlet ports, the pump housings cooperating with the pair of the axial-flow impeller units to suck a fluid located around the electric motor pump into the housings through the inlet ports, move the sucked fluid in the longitudinal direction and discharge the fluid from the outlet ports, thereby mutually canceling thrust forces along the longitudinal direction applied to the output shaft by the axial-flow impeller units in the longitudinal direction.

In the electric motor pump with the axial-flow impellers according to the present invention which is constituted in the above described manner, when the pair of axial-flow impeller units are driven by the output shaft of the electric motor, the fluid located around the electric motor pump is moved in the longitudinal direction in the pair of pump housings provided on the both sides of the electric motor in the longitudinal direction of the output shaft. Then, the movements of the fluid along the longitudinal direction at the both end portions of the output shaft mutually cancel the thrust forces along the longitudinal direction applied to the output shaft by the pair of axial-flow impeller units. As a consequence, the electric motor pump with the axial-flow impellers according to the present invention does not require a thrust bearing for the output shaft in the electric motor.

Accordingly, in the electric motor pump with the axial-flow impellers according to the present invention, the weight and the external size thereof can be reduced as compared with those of the conventional one. Besides, its price can be made cheaper than that of the conventional one. In addition, a noise generated therefrom can be made smaller than that generated from the conventional one and the life of the pump can be prolonged.

In the electric motor pump with the axial-flow impellers according to the present invention which is constituted as described above, each of the pair of pump housings has a fluid outlet port at a location farther than the axial-flow impeller unit corresponding to each of the pump housings to the electric motor and at the same time a fluid inlet port at a location nearer than the corresponding axial-flow impeller unit to the electric motor. In this case, when each of the pair of axial-flow impeller units is rotated in a predetermined direction by the output shaft of the electric motor, the fluid is sucked through the fluid inlet port and is given with Kinetic energy so that the fluid is discharged from the outlet port.

In the case where the present invention is constituted in this manner, preferably each of the fluid outlet ports of the pair of pump housings is directed outward along the longitudinal direction of the end portion of the output shaft of the electric motor, the end portion corresponding to each of the pump housings, and each of the fluid inlet ports of the pair of pump housings is directed outward along the radial direction of the corresponding end portion of the output shaft of the electric motor.

With this constitution, the movements of the fluids along the longitudinal direction at the both end portions of the output shaft can make the structure of each of the pair of pump housings being simple for mutually canceling the thrust forces along the longitudinal direction applied to the output shaft by the pair of axial-flow impeller units.

Besides, each of the pair of pump housings has a plurality of fluid inlet ports, and preferably the fluid inlet ports are arranged on each of the pump housings at a predetermined interval in a circumferential direction of the end portion of the output shaft of the electric motor, the end portion corresponding to each of the pump housings.

With this structure described above, the fluid sucked into an inner space of each of the pair of the pump housings through each of the plurality of the fluid inlet ports can be activated to mutually cancel the forces applied to the output shaft via each of the pair of the axial-flow impeller units in the radial direction of the output shaft. Consequently, the strength of each of the radial bearings can be made smaller, the weight and the external size of the electric motor pump with the axial-flow impellers according to the present invention can be further reduced and the price thereof can be further made cheaper. In addition, the noise generated from the electric motor pump can be further reduced and the life thereof can be further prolonged.

In the electric motor pump with the axial-flow impellers according to the present invention which is constituted as described above, each of the pair of pump housings can have a fluid inlet port at a location farther than the axial-flow impeller unit corresponding to each of the pump housings to the electric motor and at the same time, each of the pump housings can have a fluid outlet port at a location nearer than the axial-flow impeller unit corresponding to each of the pump housings to the electric motor. In this case, when each of the pair of the axial-flow impeller units is rotated in a predetermined direction by the output shaft of the electric motor, the fluid is sucked through the inlet port into the inner space of each the pump housing and is given with Kinetic energy so that the fluid is discharged from the fluid outlet port.

When the electric motor pump of the present invention is constituted in this manner, it is preferable that the fluid inlet port of each of the pair of pump housings is directed outward along the longitudinal direction of each of the end portions of the output shaft of the electric motor, and the fluid outlet port of each of the pair of pump housings is directed outward along the radial direction of each of the end portions of the output shaft of the electric motor.

With this structure, the movements of the fluids along the longitudinal direction at both end portions of the output shaft can make the structure of each of the pair of pump housings being simple for mutually canceling thrust forces along the longitudinal direction applied to the output shaft by the pair of axial-flow impellers.

Furthermore, it is preferable that each of the pair of pump housings has a plurality of fluid outlet ports, and the plurality of fluid outlet ports are arranged on each of the pump housings at a predetermined interval in the circumferential direction of the end portion of the output shaft of the electric motor in each of the pair of pump housings.

With this structure, the fluid discharged from the inside space of each of the pair of pump housings through each of the plurality of fluid outlet ports can act so as to mutually cancel forces applied to the output shaft via the pair of axial-flow impeller units in the radial direction of the output shaft. Consequently, the strength of each of the radial bearings can be further reduced, and the weight and the external size of the electric motor pump with the axial-flow impellers can be reduced, and the price thereof can be further made cheaper. In addition, the noise generated from the electric motor pump can be further reduced, and the life thereof can be further prolonged.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (First Embodiment)

Figure 2:
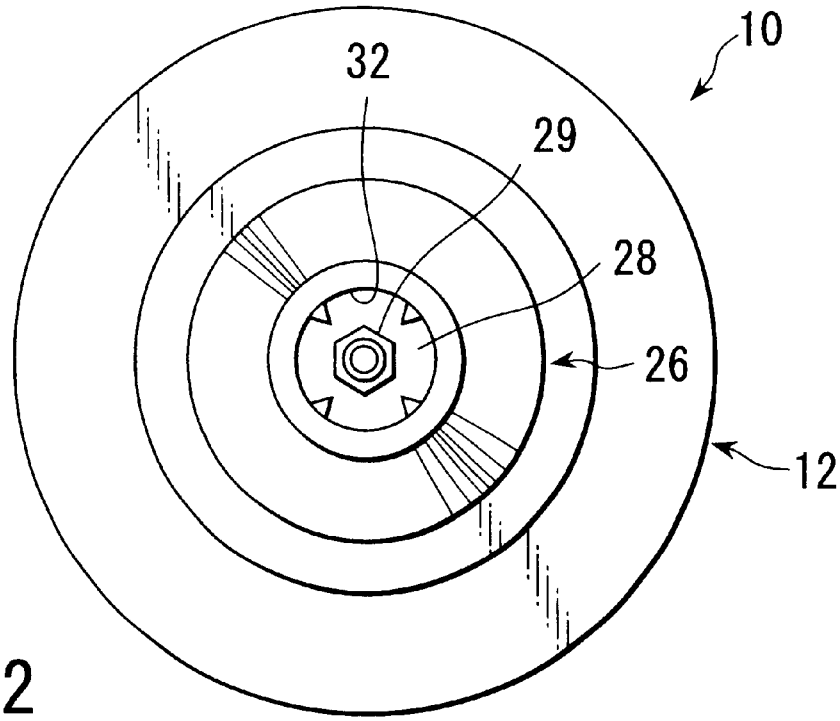
FIG. 2 is a schematic end view showing one of the end portions along a longitudinal direction of the first embodiment of FIG. 1.
Figure 3:
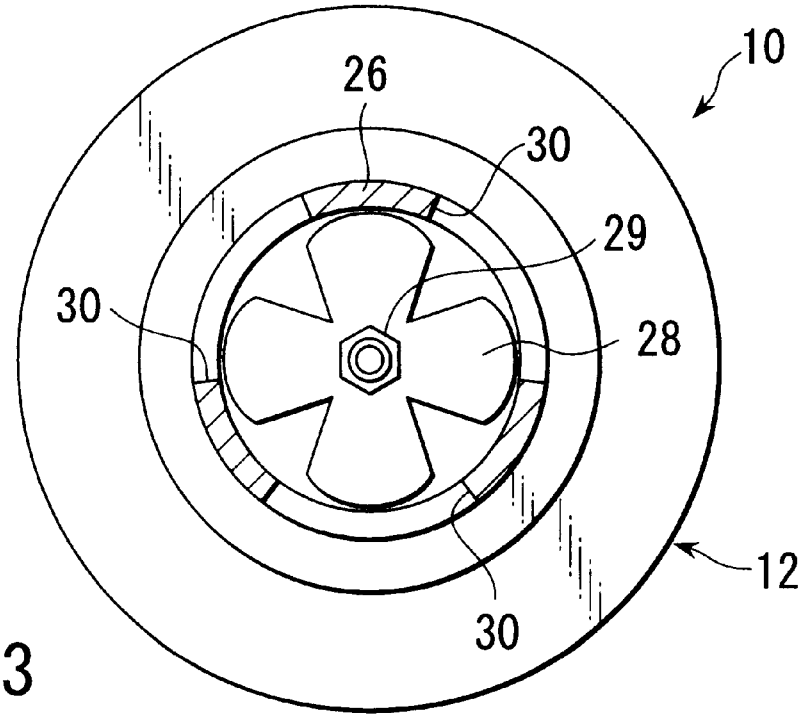
FIG. 3 is a schematic horizontal sectional view taken along a line III—III of FIG. 1.

In the beginning, a first embodiment of an electric motor pump with axial-flow impellers according to the present invention will be explained in detail by referring to FIGS. 1 through 3 in the accompanied drawings.

This electric motor pump 10 comprises an electric motor 12. The electric motor 12 includes a frame 14, an output shaft 16 both end portions of which project from the frame 14 in opposite directions, a pair of radial bearing units 18 provided on both end portions of the frame 14 in a longitudinal direction of the output shaft 16 and rotatably supporting the output shaft 16, a rotor 20 fixed to the output shaft 16 in an inner space surrounded by the frame 14, a stator 22 arranged in an outside of the frame 14 such that the stator 22 surrounds the rotor 20 in the inner space and fixed to the frame 14 with an insulating resin 21, and an excitation wiring 24 wound around the stator 22.

Well known water-tight means not shown are provided in openings of the frame 14 into which both end portions of the output shaft 16 are projected, and an insulating resin 21 fixes the stator 22 to an outside of the frame 14. The water-tight means and the insulating resin 21 seal the inner space of the frame 14 in a water-tight manner. The excitation wiring 24 of the stator 22 is connected to an alternating-current power supply with leader lines which are not shown and penetrating the insulating resin 21.

A structure of a water-proof type electric motor 12, which is constituted in the above described manner and both end portions of the output shaft 16 are projected to the outside, is well known. In this embodiment, the output shaft 16 is rotated in a predetermined direction when an electric current is supplied to the excitation wiring 24 of the stator 22 via the leader lines not shown from the alternating-current power source, and the number of revolution of the output shaft 16 can be changed by changing the frequency of the supplied alternating-current.

In this embodiment, the rotor 20, the stator 22 and the excitation wiring 24 constitute a mechanism for rotating and driving the output shaft 16.

According to the present invention, it is not required to specify the mechanism for rotating and driving the output shaft 16 in the electric motor 12.

A pair of pump housings 26 are detachably fixed to both end portions of the electric motor 12, where both end portions of the output shaft 16 are projected. The shapes and the sizes of the pair of pump housings 26 are formed in a symmetric manner on both end portions of the electric motor 12.

On both end portions of the output shaft 16 in the inner spaces of the pair of pump housings 26, a pair of axial-flow impeller units 28 are fixed by well known detachably fixing means, for example, such as nuts 29 or the like. Each of the pair of axial-flow impeller units 28 is constituted in such a manner that, when the output shaft 16 is rotated in the predetermined direction, the fluid on the end portion side of the electric motor 12 corresponding to each of the impeller units 28 in each of the inner spaces of the pump housings 26 is moved to the side far from the corresponding end portion of the electric motor 12. Besides, an amount of the fluid moved by each of the pair of the axial-flow impeller units 28 as described above per unit time is mutually set to the same level.

Each of the pair of the axial-flow impeller units 28 can be constituted as one block having a plurality of blades which are radially extended in a radial direction of the output shaft 16 at the same longitudinal direction position on the corresponding end portion of the output shaft 16. Besides, each of the pair of axial-flow impeller units 28 can be constituted by detachably fixing the plurality of such blocks to a plurality of longitudinal direction positions on the corresponding end portion of the output shaft 16.

Each of the pair of pump housings 26 has a plurality of fluid inlet ports 30 at a location nearer than the axial-flow impeller unit 28 corresponding to each of the pump housings 26, to the electric motor 12, and, at the same time, has one fluid outlet port 32 at a location farther than the axial-flow impeller unit 28 corresponding to each of the pump housings 26, to the electric motor 12.

In this embodiment, a plurality of fluid inlet ports 30 of each of the pair of pump housings 26 are directed outward in the longitudinal direction of the, corresponding end portion of the output shaft 16 of the electric motor 12, and are arranged at a predetermined interval, for example, at an equal interval, in a circumferential direction of the corresponding end portion.

One fluid outlet port 32 of each of the pair of pump housings 26 is directed outward along the longitudinal direction of the corresponding end portion of the output shaft 16. A conduit not shown is connected to the fluid outlet port 32.

Next, an operation of the electric motor pump 10 according to one embodiment constituted in this manner will be explained.

The electric motor pump 10 is sunk in a fluid which will be moved, for example, a liquid like water. When the output shaft 16 of the electric motor 12 is rotated in the predetermined direction, each of the pair of the axial-flow impeller units 28 gives Kinetic energy to the fluid on the electric motor side in the inner space of the pump housing 26 corresponding to each of the impeller units 28 to move the fluid in a direction toward the fluid outlet port 32 as indicated by an arrow X1 in FIG. 1. The fluid discharged from the fluid outlet port 32 moves to the distal end of the conduit through the above described conduit not shown.

Figure 1:
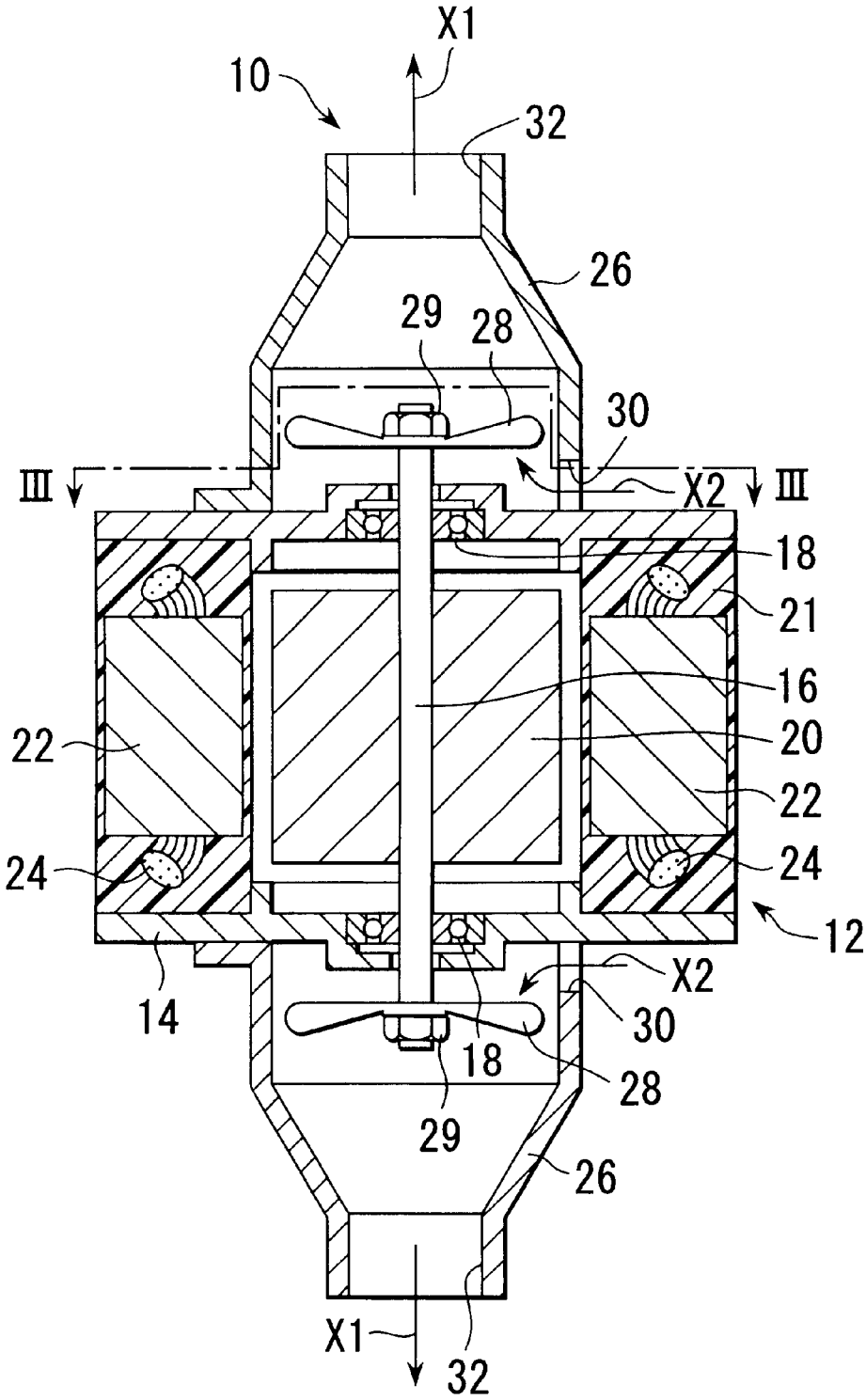
FIG. 1 is a schematic vertical sectional view showing a first embodiment of an electric motor pump with axial-flow impellers according to the present invention.

With the electric motor pump 10, the fluid located around the electric motor pump 10 is sucked into the electric motor side in the inner space of each of the pair of pump housings 26, the electric motor side being located near to the electric motor 12 than the axial-flow impeller unit 28 in the inner space of each of the pump housings 26, through the plurality of fluid inlet ports 30 as shown by an arrow X2 in FIG. 1, then the Kinetic energy is given to the sucked fluid by the corresponding axial-flow impeller unit 28.

In this embodiment, the amount and the pressure of the fluid, discharged from the fluid outlet port 32 of each of the pair of pump housings 26 of the electric pump 10, per unit time are the same as to each other. Furthermore, the directions in which the fluids are moved in the pair of pump housings 26 by the pair of axial-flow impeller units 28 are mutually opposite in the longitudinal direction of the output shaft 16 of the electric motor 12. Consequently, the thrust forces applied to the output shaft 16 by the pair of axial-flow impeller units 28 in the pair of pump housings 26 are mutually canceled.

Thus, in this embodiment, the thrust bearing for supporting the output shaft 16 against the thrust forces is not needed.

Furthermore, since the plurality of fluid inlet ports 30 of each of the pair of pump housings 26 on both sides of the electric motor 12 are arranged at an equal interval in the circumferential direction of the corresponding end portion of the output shaft 16, the forces applied to the corresponding end portion of the output shaft 16 through the corresponding axial-flow impeller unit 28 in the radial direction of the corresponding end portion of the output shaft 16, by the fluid sucked into each inner space from the plurality of fluid inlet ports 30 in each of the pair of pump housings 26 are mutually canceled. Therefore, the structure of each of the radial bearings 18 for rotatably supporting the output shaft 16 can be made small in size.

As apparent from the above description, even in the case where the electric motor pump 10 functions in the same discharge amount and the same discharge pressure as compared with the conventional electric motor pump with the pair of axial-flow impeller units on both sides of the electric motor, the thrust bearing is unnecessary, and the radial bearings can also be decreased in size. Therefore, the size of the external shape of the electric motor pump 10 is reduced and manufacturing cost thereof can be made cheaper. In addition, noise generated from the electric motor pump 10 is small and the life thereof is prolonged.

According to the present invention, the fluid inlet port 30 may be one in each of the pair of pump housings 26.

Furthermore, a plurality of fluid outlet ports 32 can be provided on each of the pair of pump housings 26. However, in this case, when the fluid is discharged from the plurality of fluid outlet ports 32 of the pair of pump housings 26, the thrust forces applied to the output shaft 16 with the pair of axial-flow impeller units 28 in the pair of pump housings 26 must be mutually canceled.

(Second Embodiment)

Figure 5:
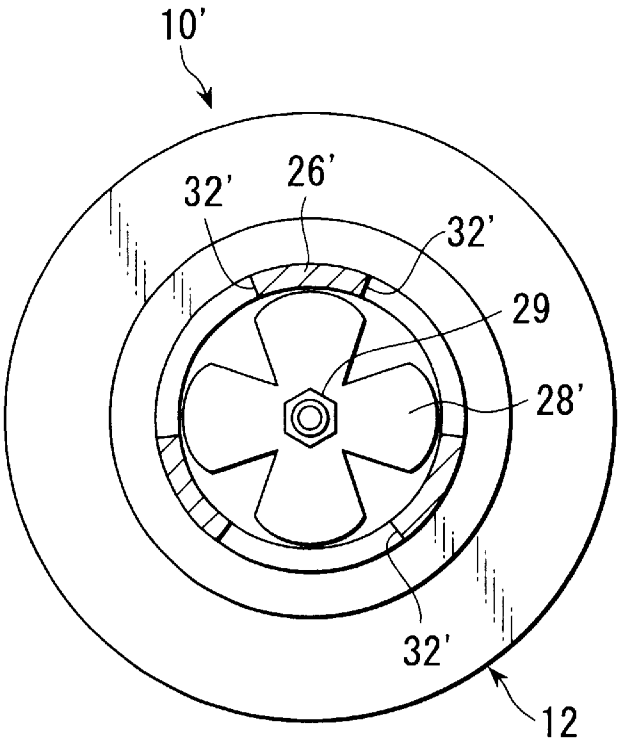
FIG. 5 is a schematic horizontal sectional view taken along a line V—V of FIG. 4.

Next, referring to FIGS. 4 and 5 in the drawings, a second embodiment of the electric motor pump with the axial-flow impellers according to the present invention will be explained in detail.

A main portion of the structure of the electric motor pump 10' according to the present embodiment is the same as a main portion of the structure of the electric motor pump 10 of the first embodiment described above with reference to FIGS. 1 to 3. Consequently, the same constituent members of the electric motor pump 10' of this embodiment as those of the electric motor pump 10 are denoted with the same reference numerals as those which denote the corresponding constituent members of the electric motor pump 10 of the first embodiment. A detailed explanation thereof will be omitted.

The electric motor pump 10' of the second embodiment uses the same electric motor 12 as that used in the electric motor pump 10 according to the first embodiment.

A pair of pump housings 26' are detachably fixed to the both end portions of the electric motor 12, where both end portions of the output shaft 16' are projected. The shapes and the sizes of the pair of housings 26' are determined in a symmetric manner on both end portions of the electric motor 12.

On both sides of the output shaft 16 in the inner spaces of the pair of pump housings 26', a pair of axial-flow impeller units 28' are fixed by well known detachably fixing means such as nuts 29 or the like. Each of the pair of axial-flow impeller units 28' is constituted to function in a manner opposite to each of the pair of the axial-flow impeller units 28 of the first embodiment. That is, each of the pair of axial-flow units 28' is so constituted that, when the output shaft 16 is rotated in the predetermined direction, the fluid located on the side far from the corresponding end portion of the electric motor 12 in each of the inner spaces of the pump housings 26' is moved to the corresponding end side portion of the electric motor 12. Further, an amount of the fluid, moved by each of the pair of axial-flow impeller units 28' as described above, per unit time is mutually set to the same level.

Each of the pair of the pair of axial-flow impeller units 28' can be constituted as one block having a plurality of blades which are radially extended in the radial direction of the output shaft 16 at the same longitudinal direction position on the corresponding end portion of the output shaft 16, and each of the pair of axial-flow impeller units 28' can be constituted by detachably fixing the plurality of such blocks to a plurality of longitudinal direction positions on the corresponding end portion of the output shaft 16.

Each of the pair of pump housings 26' has the same external shape as each of the pump housings 26 according to the first embodiment. However, each of the pair of pump housings 26' has one fluid inlet port 30' at a location farther than the axial-flow impeller unit 28' corresponding to each of the pump housings 26', to the electric motor 12, and, at the same time, has a plurality of fluid outlet ports 32' at a location nearer than the axial-flow impeller unit 28' corresponding to each of the pump housing 26, to the electric motor 12.

The fluid inlet port 30' of each of the pair of pump housings 26' is directed outward along the longitudinal direction of the corresponding end portion of the output shaft 16.

In this embodiment, a plurality of fluid inlet ports 30' of each of the pair of pump housings 26' are directed outward in the radial direction of the corresponding end portion of the output shaft 16 of the electric motor 12, and is arranged at a predetermined interval, for example, an equal interval in the circumferential direction of the corresponding end portion. A conduit not shown is connected to each of the fluid outlet ports 32'.

Next, an operation of the electric motor pump 10' of the second embodiment which is constituted as described above will be explained.

The electric motor pump 10' is sunk in a fluid which will be moved, for example, a liquid like water. When the output shaft 16 of the electric motor 12 is rotated in the predetermined direction, each of the pair of axial-flow impeller units 28' gives Kinetic energy to the fluid on the side far from the electric motor 12 in the inner space of the corresponding pump housing 26' to move the fluid to a plurality of fluid outlet ports 32' as designated by the arrow X'1 in FIG. 4. The fluid discharged from each of the plurality of the fluid outlet ports 32' moves to the distal end of the conduit through the above described conduit not shown.

Figure 4:
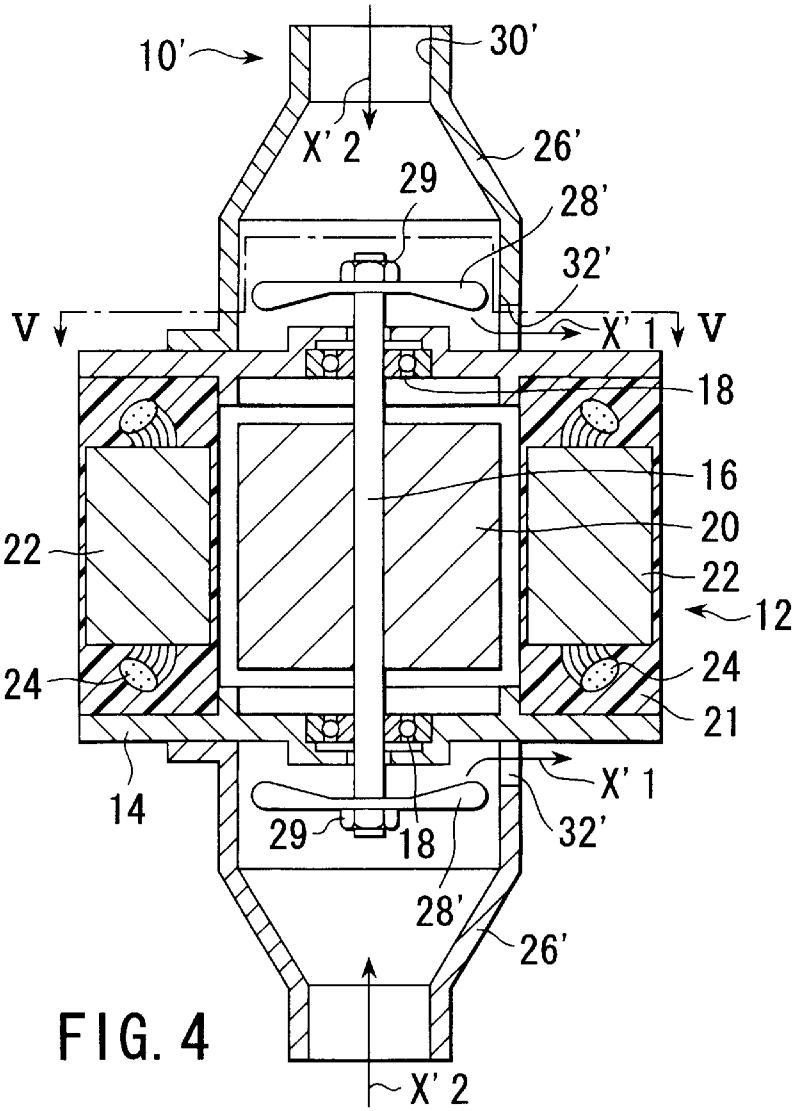
FIG. 4 is a schematic sectional view showing a second embodiment of the electric motor with the axial-flow impellers according to the present invention.

With the electric motor pump 10', the fluid located around the electric motor pump 10' is sucked through one fluid inlet port 30' into the side far from the electric motor 12 in each of the pair of pump housings 26' than to the corresponding axial-flow impeller unit 28' in the inner space of each of the pair of the pump housings 26' as shown by an arrow X' 2 in FIG. 4. Then, the Kinetic energy is given to the sucked fluid by the corresponding axial-flow impeller unit 28'.

In this embodiment, the amount and the pressure of the fluid, discharged from the plurality of fluid outlet ports 32' of each of the pair of pump housings 26' of the electric motor pump 10', per unit time are the same as to each other. Further, the directions in which the fluids are moved in the inner spaces of the pair of pump housings 26' by the pair of axial-flow impeller units 28' are coming close to each other in the longitudinal direction of the output shaft 16 of the electric motor 12. Consequently, the thrust forces applied to the output shaft 16 by the pair of axial flow impeller units 28' in the pair of pump housings 26' are mutually canceled.

Thus, in this embodiment, the thrust bearing for supporting the output shaft 16 against the thrust forces is not needed.

Furthermore, since the plurality of fluid outlet ports 32' of each of the pair of the pump housings 26' on both sides of the electric motor 12 are arranged at an equal interval in the circumferential direction of the corresponding end portion of the output shaft 16, the forces applied to the corresponding end portion of the output shaft 16 through the corresponding axial-flow impeller units 28' in the radial direction of the corresponding end portion of the output shaft 16, by the fluid discharged out from the plurality of fluid outlet ports 32' are mutually cancelled. Therefore, the structure of each of the radial bearings 18 for rotatably supporting the output shaft 16 can be made small in size.

As apparent from the above description, even in the case where the electric motor pump 10' in this embodiment functions in the same discharge amount and the same discharge pressure as compared with the conventional electric motor pump with the pair of axial-flow impeller units on both sides of the electric motor 12, the thrust bearing is unnecessary, and the radial bearings can be made smaller in size. Therefore, the size of the external shape of the electric motor pump 10' is reduced and manufacturing cost thereof can be made cheaper. In addition, the noise generated from the electric motor pump 10' is small and the life thereof can be prolonged.

According to the present invention, as far as the thrust forces applied to the output shaft 16 by the pair of the axial-flow impeller units 28' in the pair of pump housings 26' are mutually canceled, only one fluid inlet port may be formed by converging each of the pair of pump housings 26'.

Furthermore, it is possible to provide a plurality of fluid inlet ports 30' on each of the pair of the pump housings 26'.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electric motor pump comprising:

an electric motor having first and second opposite sides and an output shaft having first and second ends, both of the first and second ends of the output shaft respectively projecting from the first and second opposite sides in opposite directions, the output shaft rotating in a predetermined rotation direction;

a pair of axial-flow impeller units connected to respective first and second ends of the output shaft, the pair of axial-flow impeller units providing fluid in opposite directions to each other when the output shaft of the electric motor rotates in the predetermined rotation direction; and a pair of pump housings provided on the respective first and second opposite sides of the electric motor and covering one of the respective pair of axial-flow impeller units, each of the pump housings having a fluid inlet port and a fluid outlet port, the fluid inlet port being more distal with respect to the side of the electric motor corresponding to the fluid inlet port than the axial-flow impeller unit corresponding to the fluid inlet port and being directed in a direction away from the corresponding side of the electric motor along the longitudinal center line of the output shaft, and the fluid outlet port being less distal with respect to the corresponding side of the electric motor than the corresponding axial-flow impeller unit and being directed in a direction which crosses the longitudinal center line of the output shaft;

wherein, when the output shaft of the electric motor rotates in the predetermined rotation direction, thrust forces applied to the output shaft via the axial-flow impeller units by fluid provided into the pump housings through the fluid inlet ports and expelled out from the pump housings through the fluid outlet ports are mutually cancelled.

2. The electric motor pump according to claim 1, wherein each of the pair of pump housings has a plurality of fluid outlet ports, and the fluid outlet ports are arranged at predetermined intervals in a circumferential direction with respect to each pump housing.

3. An electric motor pump comprising:

an electric motor having first and second opposite sides and an output shaft having first and second ends, both of the first and second ends of the output shaft being projected from the first and second opposite sides in opposite directions, the output shaft being rotated in a predetermined rotation direction;

a pair of axial-flow impeller units connected to respective first and second ends of the output shaft, the pair of axial-flow impeller units providing the same amount of fluid in the opposite directions when the output shaft of the electric motor rotates in the predetermined rotation direction; and a pair of pump housings provided on the respective first and second opposite sides of the electric motor and covering one of the respective pair of axial-flow impeller units, each of the pump housings having a fluid inlet port and a fluid outlet port, the fluid outlet port being more distal with respect to the side of the electric motor corresponding to the fluid outlet port than the axial-flow impeller unit corresponding to the fluid outlet port and being directed in a direction away from the corresponding side of the electric motor along the longitudinal center line of the output shaft, and the fluid inlet port being less distal with respect to the corresponding side of the electric motor than the corresponding axial-flow impeller unit and being directed in a direction crossing the longitudinal center line of the output shaft;

wherein, when the output shaft of the electric motor rotates in the predetermined rotation direction, thrust forces applied to the output shaft via the axial-flow impeller units by fluid provided into the pump housings through the fluid inlet ports and expelled out from the pump housings through the fluid outlet ports are mutually cancelled.

4. The electric motor pump according to claim 3, wherein each of the pair of pump housings has a plurality of fluid inlet ports, and the fluid inlet ports are arranged at predetermined intervals in a circumferential direction with respect to each pump housing.

* * * * *